US008057316B2

(12) United States Patent
Legary et al.

(10) Patent No.: US 8,057,316 B2
(45) Date of Patent: Nov. 15, 2011

(54) BUMPER BOAT AMUSEMENT ATTRACTIONS, METHODS AND SYSTEMS AND WATER EFFECT DEVICE USABLE IN SAME

(76) Inventors: Brian Legary, Grande Pointe (CA); James Legary, Grande Pointe (CA)

( * ) Notice: Subject to any disclaimer, the term of this patent is extended or adjusted under 35 U.S.C. 154(b) by 133 days.

(21) Appl. No.: 12/617,060

(22) Filed: Nov. 12, 2009

(65) Prior Publication Data

US 2011/0111871 A1 May 12, 2011

(51) Int. Cl.
*A63G 3/02* (2006.01)
*A63G 3/00* (2006.01)

(52) U.S. Cl. ..... 472/13; 472/128; 472/129; 104/70

(58) Field of Classification Search ..... 472/13, 472/117, 128, 129, 43, 59, 60, 61, 137; 104/53, 104/69, 70, 73
See application file for complete search history.

(56) References Cited

U.S. PATENT DOCUMENTS 6,375,578 B1 * 4/2002 Briggs ..... 472/117
6,561,914 B2 * 5/2003 Henry ..... 472/13
6,702,687 B1 * 3/2004 Henry ..... 472/128

* cited by examiner

*Primary Examiner* — Kien Nguyen
(74) *Attorney, Agent, or Firm* — Kyle R. Satterthwaite; Ryan W. Dupuis; Ade & Company Inc.

(57) ABSTRACT

An amusement device that is added to a new or existing bumper boat attraction, consisting of a singular or plurality of targets, lights, water effect devices, and a control system or module. The target may be comprised of a mechanical switch, pressure switch, sensor, optical beam, or any other device for detecting a participant signal. When a participant operating a bumper boat, bumps (or sprays if equipped with onboard squirt guns), or enters into the sensor area of pool, a signal is sent to a control module or control system. The control module or system will in turn send a signal to a water effect device, actuating a singular or plurality of valves. The water effect device will be directed over the pool or arena area such that there is a possibility of other participants getting wet. A water effect device may consist of a water cannon, water blast, mist, air assisted mist, dumping of water or water spray.

19 Claims, 9 Drawing Sheets

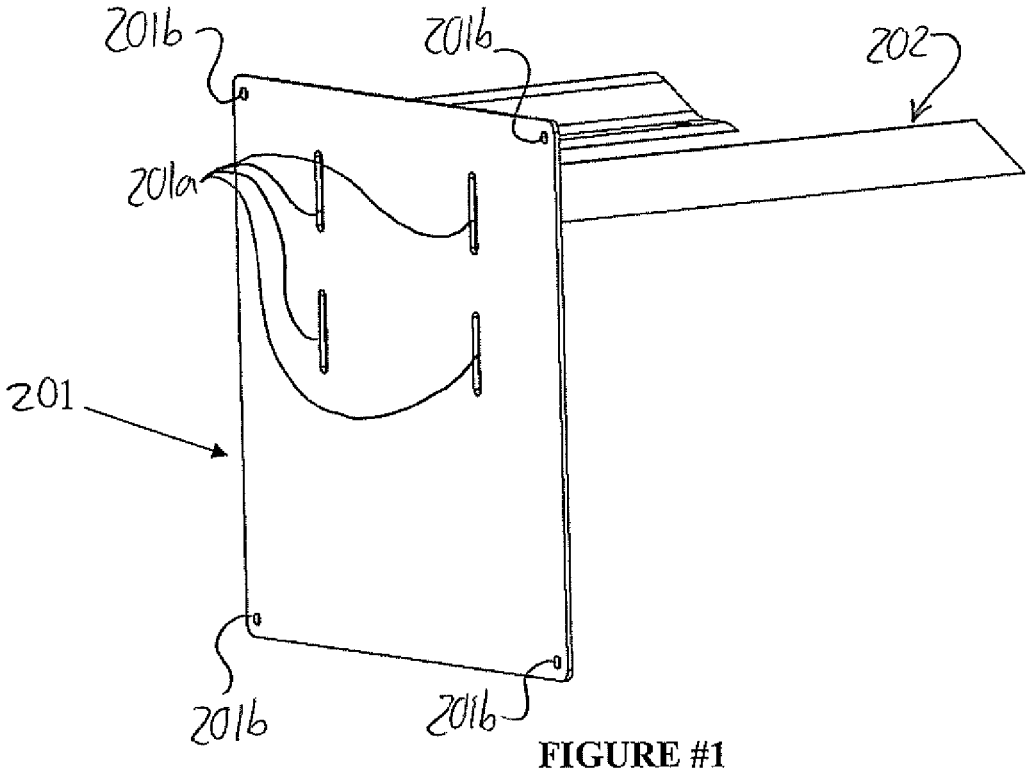
FIGURE #1
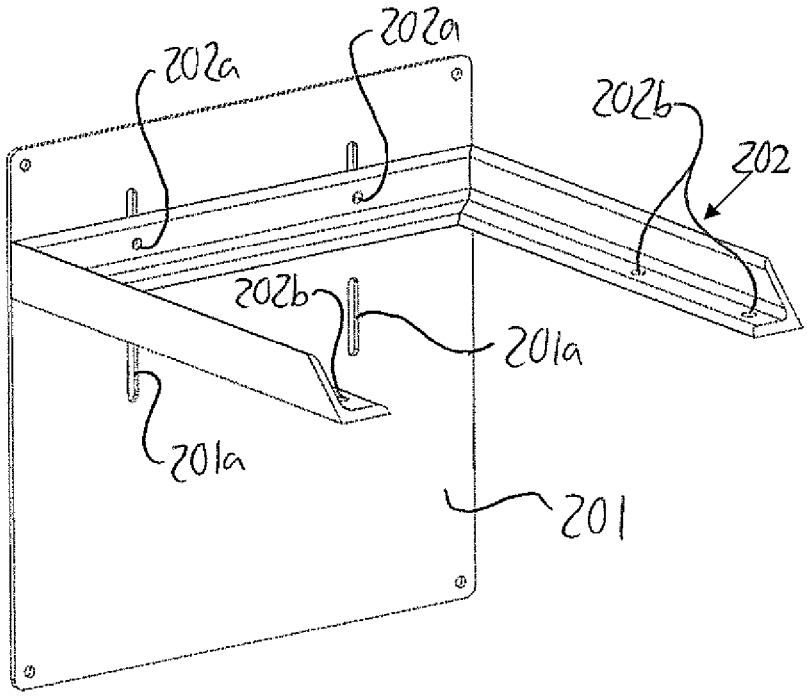
FIGURE #2

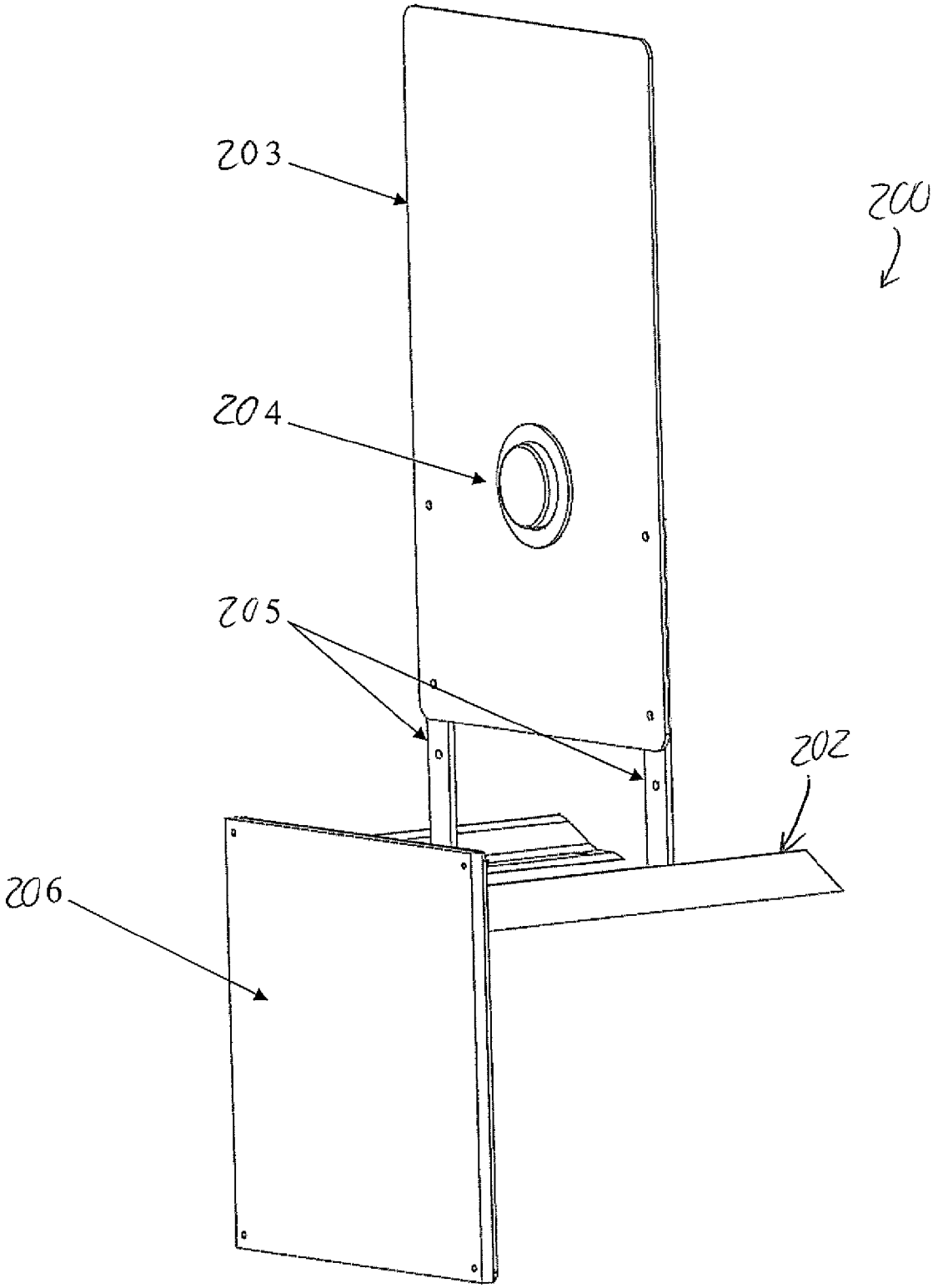
FIGURE #3

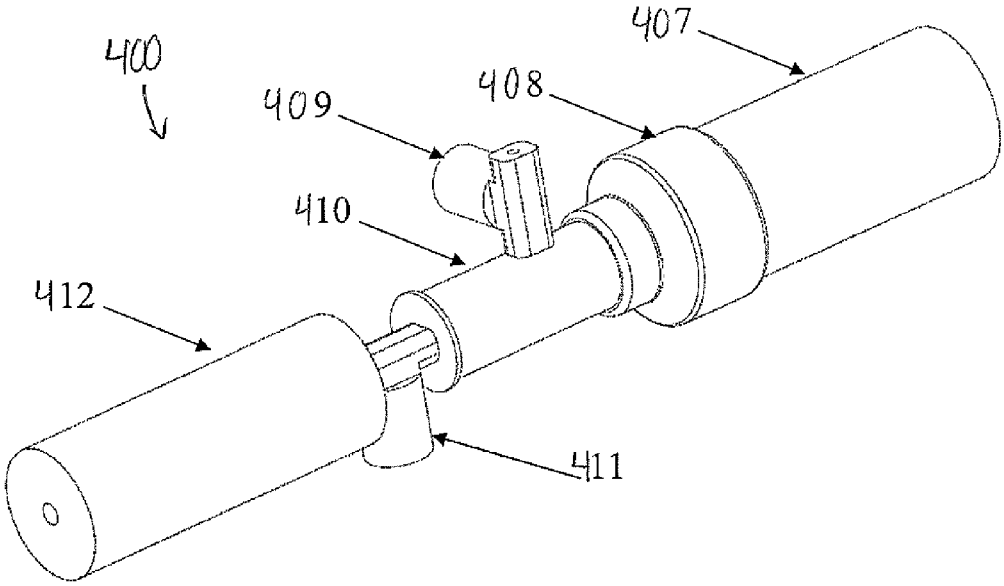
FIGURE #4
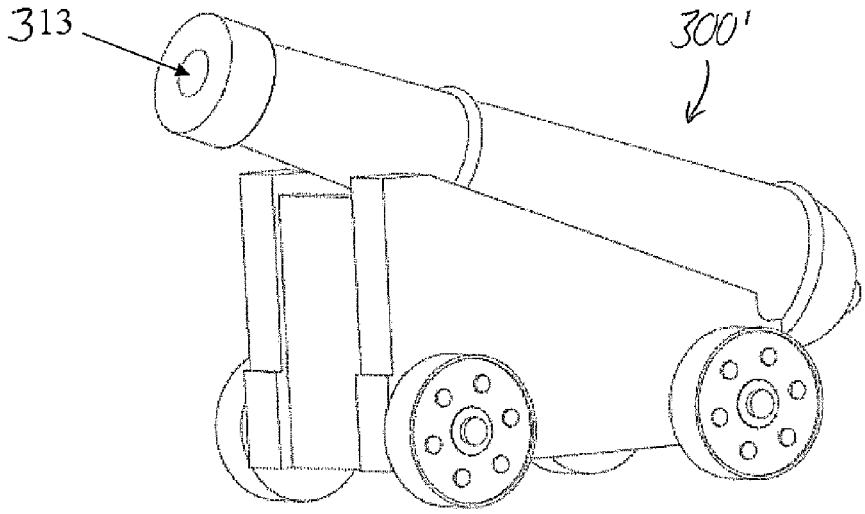
FIGURE #5

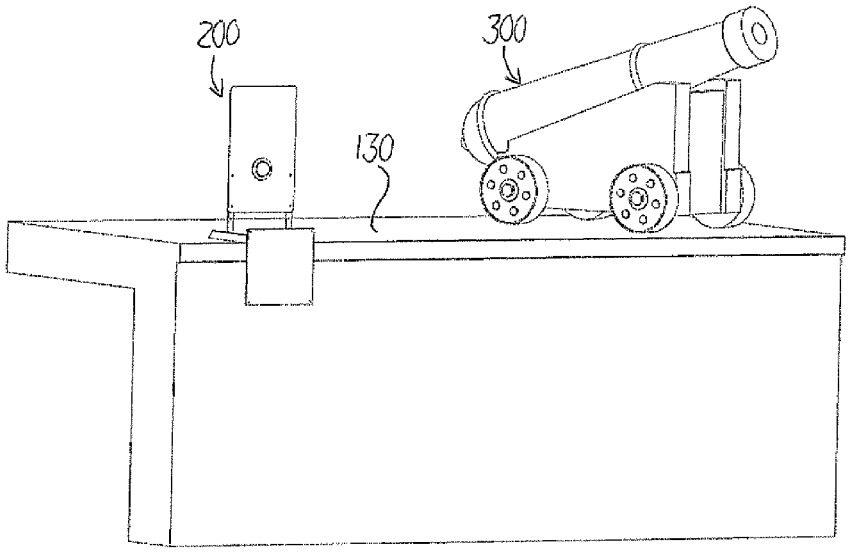
FIGURE #6B
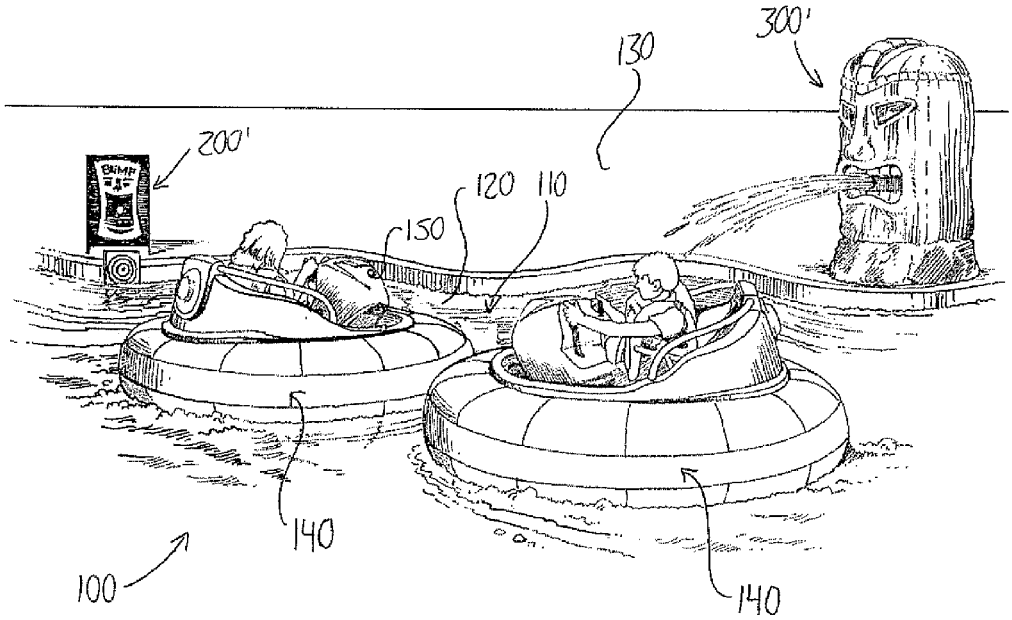
FIGURE #6A

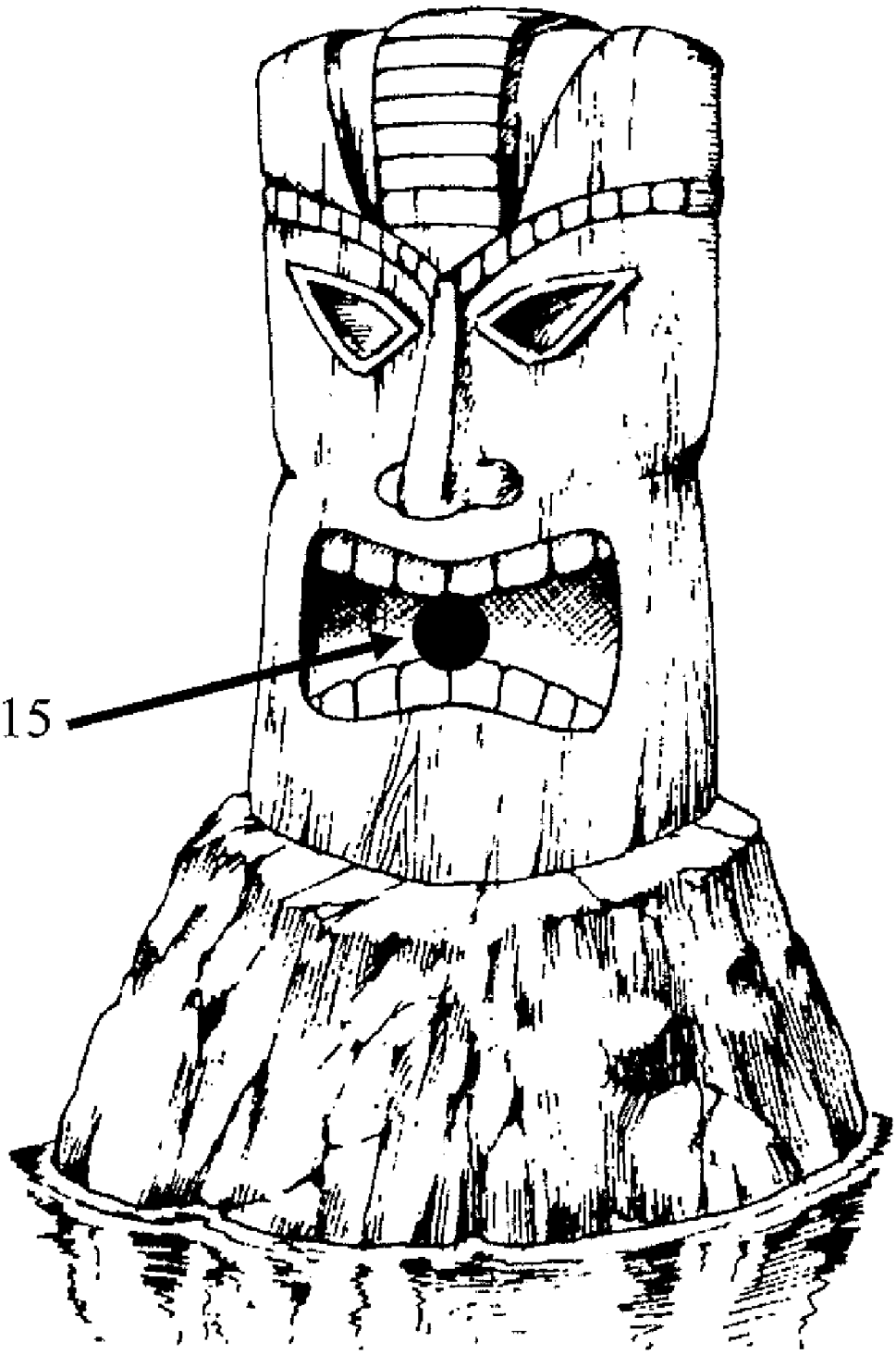
FIGURE #7

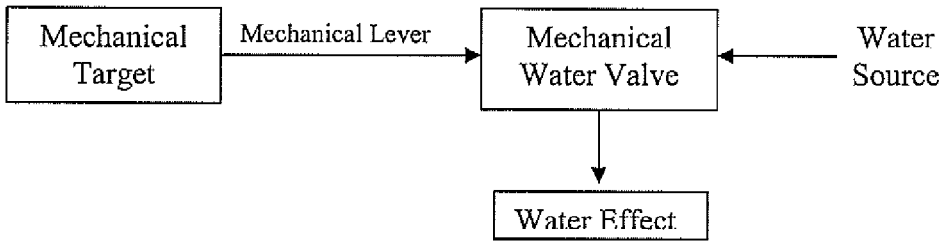
FIGURE #8
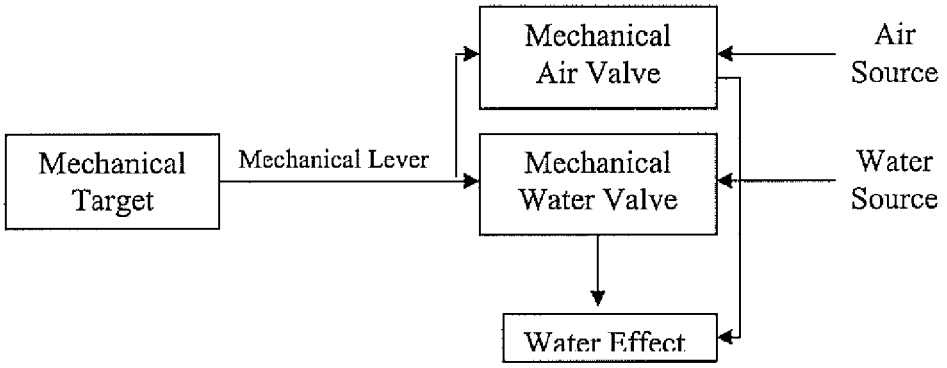
FIGURE #9
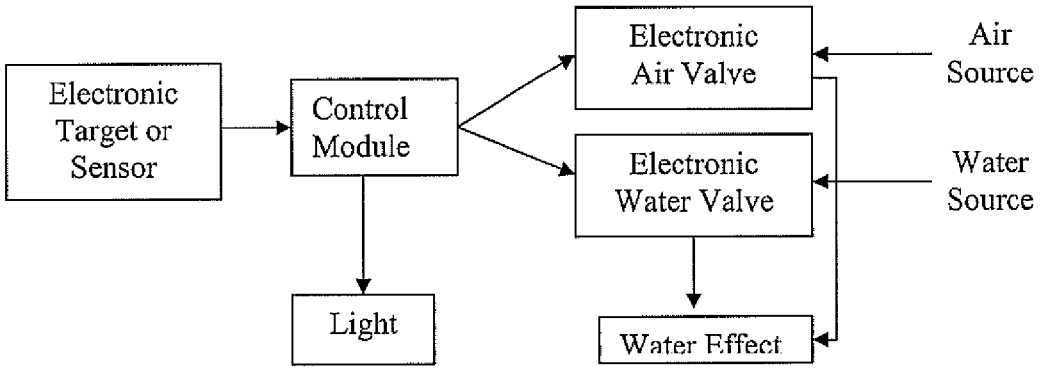
FIGURE #10

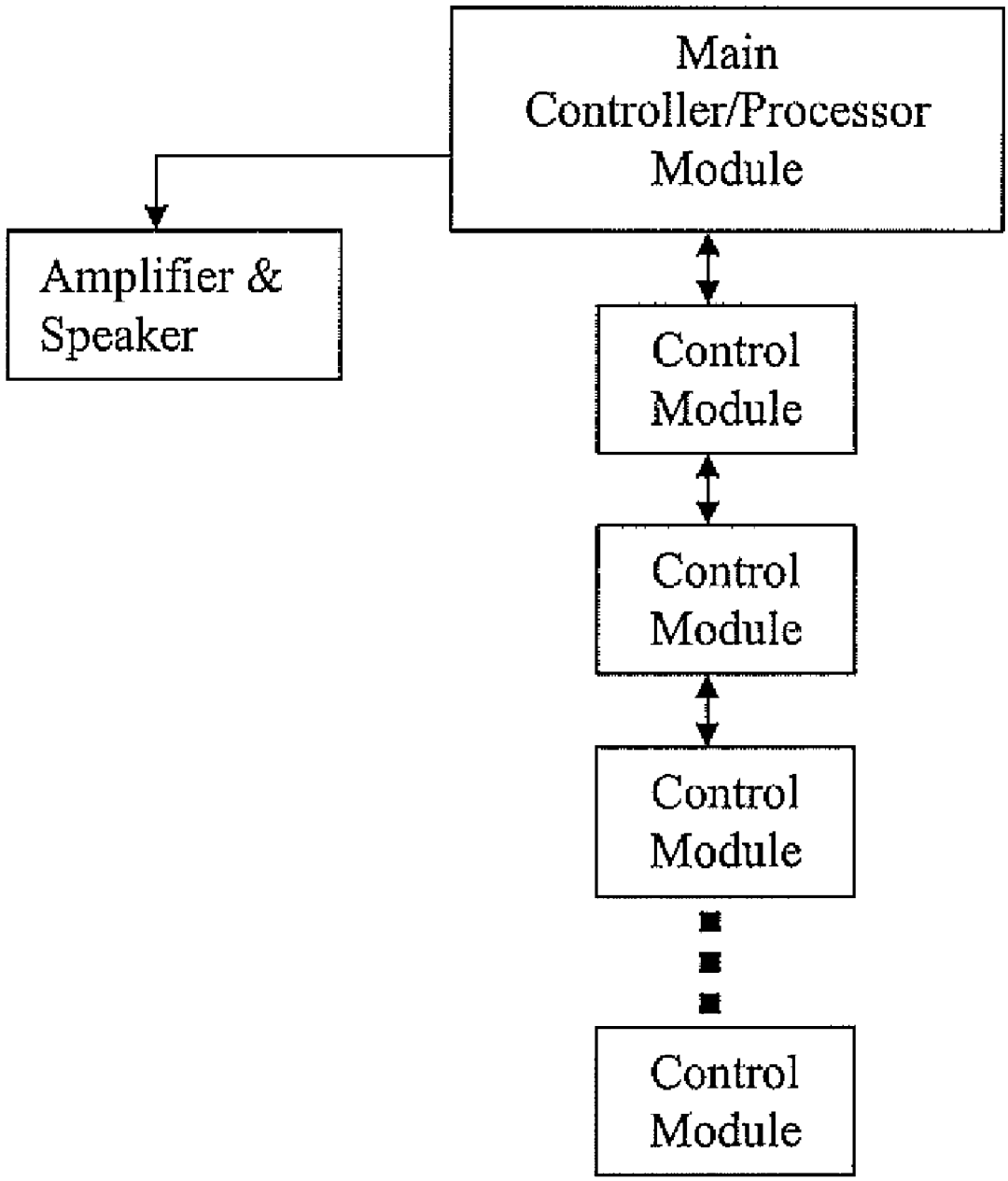
FIGURE #11

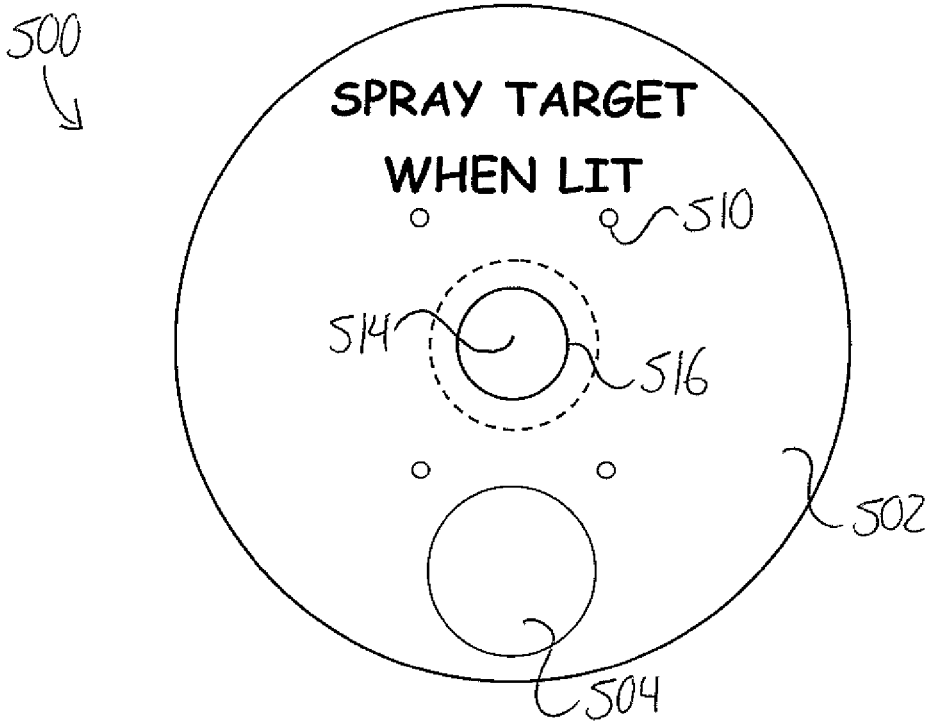
FIGURE #12A
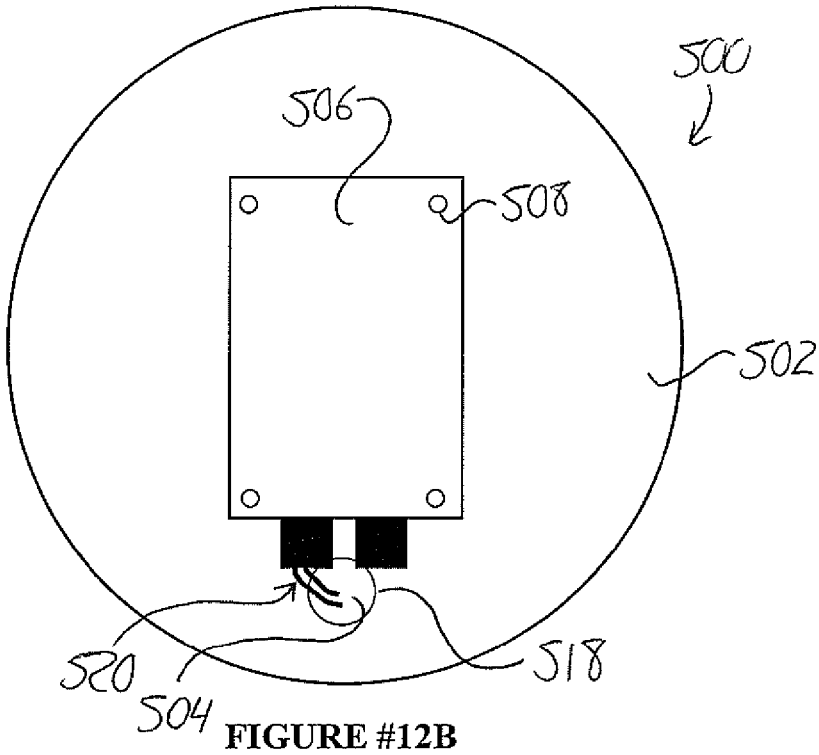
FIGURE #12B

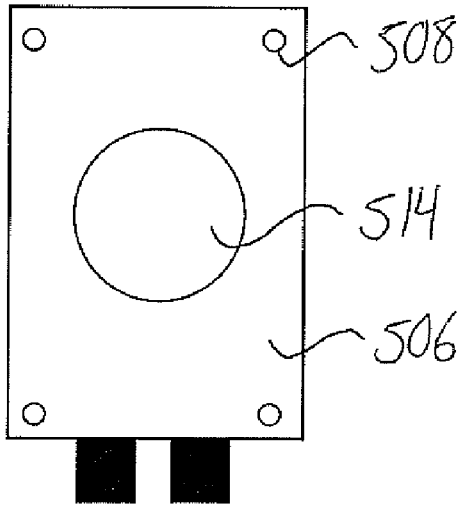
FIGURE #13A
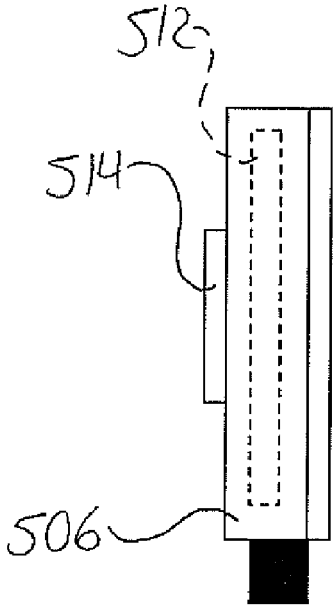
FIGURE #13B

BUMPER BOAT AMUSEMENT ATTRACTIONS, METHODS AND SYSTEMS AND WATER EFFECT DEVICE USABLE IN SAME

FIELD OF THE INVENTION

The invention generally relates to water-based amusement rides and attractions. More specifically it relates to adding water effect devices to a bumper boat attraction, wherein a participant in a boat may bump or spray a target at the edge of the body of water to activate a water effect such as a water cannon, water blast, spray, mist, or dumping of water on one or more participants or observers at or around the attraction area.

BACKGROUND OF THE INVENTION

Amusement park attractions have included bumper boats as a participatory ride allowing participants to steer their vehicles in a pool of water and bump into one another at a safe speed. Some bumper boats are also equipped with a water sprayer such that participants can spray at one another, increasing the level of interaction between participants of the ride. The present invention improves the entertainment value over prior art bumper boat attractions by adding an interactive target system that takes the ride to an even higher level of participation and interaction.

A brief summary of prior art patents relating to the general field of water-based amusement is provided as follows.

U.S. Pat. No. 7,179,173 for a water control system teaches that the combination of a control system and water effects can be a fun way to have people in a water park or water play area interact with targets or sensors triggering water effects. However, it does not in any way teach or suggest incorporation of any such arrangement into a bumper boat attraction.

U.S. Pat. No. 5,382,026 shows a moving vehicle shooting gallery where participants riding in boats on a track can spray targets as they pass to activate water effects and score points. Participants cannot control their boat nor can the boats contact other boats.

U.S. Patent Application Publication Number 2007/0087850 adds competition to water play areas and tube rides. The amusement attraction involves participants actively competing in certain events or on a tube ride, but does not apply to bumper boat areas where participants can steer their boats.

U.S. Pat. Nos. 6,786,830; 5,149,048; and 5,820,471 all relate to water effects being generated in participatory water play structures.

U.S. Pat. No. 6,702,687 describe control systems for water amusement devices relating to water play areas Tornado Company in the UK (www.tornado-uk.com) has a remote control boat game where participants drive remote control boats and try to dock them or maneuver through obstacles which may produce an effect, but participants do no ride in the boats and water effects are not directed at other participants.

A similar system is installed at Disneyland in 1999 by Thola Productions (www.thola.com).

In addition, Tornado offers a bumper car system in which participants can shoot an infrared beam at other participants, and a hit will cause the other participant to spin. It does not have a target to bump nor water effects to spray participants or observers. Furthermore, this is not a bumper boat attraction.

U.S. Pat. No. 6,561,914 describes a bumper boat system where boats can be steered by participants and participants can spray one another with water guns. It uses water pulses to power these boats but does not use a target on the side of the pool to trigger water effects.

SUMMARY OF THE INVENTION

According to a first aspect of the invention there is provided a bumper boat amusement attraction comprising:

a body of water;

a plurality of bumper boats deployable out over the body of water to be driven along a surface thereof by respective participants;

a target disposed proximate the body of water and arranged to provide an output action in response to an input action taken upon the target by one of the participants; and a water effect device arranged to be activated by the output action of the target to produce a water effect.

Each bumper boat may comprise a water shooting device operable by the respective participant to propel water through the air above the surface of the body of water and the target may accordingly be arranged to provide the output action in response to being contacted by the propelled water.

The water shooting device may be arranged to propel the water in a continuous stream or in discrete shots.

The target may be wired to an indicator that is arranged to intermittently activate to signal the participants to attempt to take the input action on the target and the target is arranged to provide the output action in response to the input action only if the input action is taken upon the target while the indicator is activated.

Preferably the indicator comprises a visual indicator providing a visual signal at a position viewable by the participants.

Preferably the indicator comprises a light situated at a position viewable by the participants.

The target may comprise a switch actuable to effect the output action by driving of one of the bumper boats into contact with the target.

Alternatively, the target may comprise a sensor operable to detect presence of one of the bumper boats proximate the target and effect the output action in response thereto. A water sensing target may also be used to detect a spray of water from an on-board squirt gun should the bumper boat attraction be so equipped.

There may be provided a sound device arranged to convey audible signal in response to the input action taken on the target.

The attraction may comprise an electronic control system arranged to activate the water control device in response to the input action at the target A main electronic controller of the electronic control system preferably comprises a tinier arranged to time a ride length of the attraction, is arranged to start the timer in response to an operator input and produce a ride expiry signal at the expiry of the timer.

The electronic control system is preferably arranged to also activate the water control device absent the input action, preferably when the timer is not running.

The main electronic controller is preferably arranged to convey an audible announcement at the expiry of the timer.

The target is preferably disposed adjacent a boundary edge of the body of water.

The attraction may comprise a pool containing the body of water and the target may be mounted at a side of the pool above the surface of the body of water and depend downward from the side of the pool toward the surface of the body of water.

There may be provided multiple ones of the target. In this instance, preferably there are provided multiple ones of the water effect device, in which case each water effect device may be arranged to be activated by the output action of a respective one of the targets.

The water effect device may comprises a hollow tubular passage communicable with a water source to receive a predetermined amount of water in the tubular passage under each communication thereof with the water source and a normally closed gas valve openable to communicate a pressurized gas source with the tubular passage from an end thereof opposite an open end of the tubular passage, the normally closed gas valve being arranged to open under the output action of the target to expose the water in tubular passage to the pressurized gas source after full receipt of the predetermined amount of water in the tubular passage to drive the predetermined amount of water out of the tubular passage through the open end thereof.

The water effect device may further comprise a normally closed water valve openable to communicate the water source with the tubular passage to deliver the predetermined amount of water thereto, with the bumper boat amusement attraction further comprising an electronic control system arranged to open the normally closed water valve in response to the input action at the target and then, after a delay sufficient to allow full receipt and pooling of the predetermined amount of water in the tubular passage, open the normally closed gas valve to drive the predetermined amount of water out of the tubular passage through the open end thereof.

According to a second aspect of the invention there is provided an amusement method for a bumper boat amusement attraction comprising a body of water and a plurality of bumper boats deployable out over the body of water to be driven along a surface thereof by respective participants, the method comprising the steps of:

providing a target and a water effect device at positions proximate the body of water;

allowing each participant to maneuver the bumper boats around the body of water and attempt to effect an input action upon the target; and generating a water effect at the water effect device in response to the input action on the target to produce a water effect.

According to a third aspect of the invention there is provided a target system for a bumper boat amusement attraction comprising a body of water and a plurality of bumper boats deployable out over the body of water to be driven along a surface thereof by respective participants, the system comprising a target and a water effect device arranged for mounting at positions proximate the body of water, the water effect device being arranged to communicate with a water supply and produce a water effect using the water supply in response to an input action taken upon the target by one of the participants.

According to a fourth aspect of the invention there is provided a water effect device comprising a hollow tubular passage communicable with a water source to receive a predetermined amount of water in the tubular passage under each communication thereof with the water source and a normally closed gas valve openable to communicate a pressurized gas source with the tubular passage from an end thereof opposite an open end of the tubular passage, the normally closed gas valve being arranged to open only after full receipt of the predetermined amount of water in the tubular passage to drive the predetermined amount of water out of the tubular passage through the open end thereof.

Preferably there is provided a normally closed water valve openable to communicate the water source with the tubular passage to deliver the predetermined amount of water thereto and the water effect device is provided in combination with an electronic control system arranged to first open the normally closed water valve and then, after a delay sufficient to allow full receipt and pooling of the predetermined amount of water in the tubular passage, open the normally closed gas valve to drive the predetermined of water out of the tubular passage through the open end thereof.

This arrangement in which valves controlling water and compressed air (or other gas) are opened sequentially in this order provides more of a cohesive blast-like discharge of water from the device than prior art devices where air and water valves are opened simultaneously, resulting in a spraying or misting of the water as the air pushes through water entering the tube or barrel of the device.

BRIEF DESCRIPTION OF THE DRAWINGS

In the accompanying drawings, which illustrate exemplary embodiments of the present invention:

FIG. 1 is a front side perspective view of a main target support to be mounted to the side of a bumper boat pool.

FIG. 2 is a rear side perspective view of the main target support of FIG. 1.

FIG. 3 is a front side perspective view of a complete target assembly featuring the main target support of FIGS. 1 and 2 and configured for triggering of the target by driving of a bumper boat against a target pad of the assembly.

FIG. 4 is a perspective view mechanism used to create an explosion or blast of water in a water effect device.

FIG. 5 is a front side perspective view of one design possibility for a housing of the water effect device.

FIG. 6A is a perspective view of one possible layout for an interactive target system installed at the side of a bumper boat pool.

FIG. 6B is a partial perspective view of another interactive target system installed at the side of a bumper boat pool and employing the target assembly and water effect device of FIGS. 3 and 5.

FIG. 7 is a perspective view of another design possibility for a housing of the water effect device.

FIG. 8 schematically illustrates a mechanical system layout for a mechanical target actuating a mechanical lever or system of levers to actuate one or more mechanical valves connected to a water source, resulting in a water effect being produced.

FIG. 9 schematically illustrates a mechanical system layout for a mechanical target actuating a mechanical lever or system of levers to actuate one or more mechanical valves connected to both air and water sources.

FIG. 10 schematically illustrates an electronic system layout for an electronic target.

FIG. 11 shows how an array of control modules may be connected to a main processor or controller to control an interactive bumper boat target system of the present invention.

FIG. 12A is a schematic front elevational view of an alternate embodiment target assembly configured for triggering of the target by spraying thereof with water from a water shooting device carried on a bumper boat.

FIG. 12B is a schematic rear elevational view of the target assembly of FIG. 12A.

FIG. 13A is a schematic front elevational view of an electrical component enclosure of the target assembly of FIG. 12.

FIG. 13B is a schematic side elevational view of the enclosure of FIG. 13A.

DETAILED DESCRIPTION

FIG. 6A illustrates a bumper boat attraction 100 equipped with an interactive target system according to the present invention to provide a further level of interaction between participants over prior art bumper boat attractions. In a conventional manner, the attraction features a pool 110 filled with water 120 and surrounded by an apron 130 on all four sides. A plurality of bumper boats 140 are moored along one or more sides of the pool 110 when the attraction is not in use, and then are deployed out over the water after being boarded by participants. In a conventional manner, the participants are giving control over operation of their respective boats in order to allow independent driver-controlled maneuvering of the boats along the surface of the pool's body of water. In the illustrated embodiment, each boat is equipped with a water spraying or shooting device 150 so that each participant is free to attempt to direct a stream, pulse or charge of water toward the other participants on the other boats. Conventional spray-equipped or non-spray-equipped bumper boats may be used in a water amusement attraction of the present invention without requiring any modification, and accordingly no further structural details of these boats are given herein.

Referring to FIGS. 6A and 6B, the illustrated target system of the present invention features a target assembly 200, 200' and a water effect device 300, 300' installed proximate the body of water 120, for example on the pool apron 130 on one side of the pool. The target assembly 200, 200' and water effect device 300, 300' are wired together via an electronic controller so that an input action carried out by a participant at the target assembly 200, 200' will cause the water effect device 300, 300' to generate a water effect. The input action by the participant may be provided by bumping the boat against the target to actuate a switch thereon, bringing the boat into close enough proximity to the target to be detected by a proximity sensor thereon, or shooting the target with water from the boat's spray device. Accordingly the target may feature a pressure switch, sensor, motion detector, optical beam, water sensor, or other arrangements operable to detect the presence of a bumper boat or directed spray at a predetermined location for the purpose of triggering a water effect. In response to the input action, the water effect device may generate a water blast, water cannon/explosion, water mist, air-assisted water mist, water spray, pulsed water spray, or dumping of water.

FIG. 1 is a perspective view of a main target support of the target assembly of FIGS. 3 and 6B to be mounted to the side of the bumper boat pool. A vertically oriented rectangular plate 201 is used to hold the target to the mount and is preferably a stainless steel or powder coated steel plate with mounting holes to allow for the attachment of a pressure switch pad. Three lengths of angle iron arranged end-to-end in a horizontal U-configuration form a mounting bracket 202 to support the plate 201. Two angle iron pieces project normally away from the plate 201 adjacent opposite vertical sides thereof and proximate the top of the plate to define two legs of the bracket's U-shape in plan. The third piece perpendicularly connects to the two parallel bracket pieces along a rear face of the plate and is fixed thereto. Each piece of angle iron is oriented to stand one leg of its L-shaped cross-section upright and lay the other leg horizontally flat. As shown in FIG. 2, vertically extending slots 201*a* in the plate 201 align with holes 202*a* in the upright leg of the middle bracket piece to allow for mounting of the bracket 202 to the plate 201 at different heights along the plate using threaded fasteners passed through the slots and holes in order to allow adjustment of the final installation height of the plate. The flat horizontal bottom leg of each of the two parallel lengths of angle iron has vertical mounting holes 202*b* passing through it at spaced positions along the lengthwise axial direction of the angle iron piece to allow for the target mount to be affixed to the apron of the pool via concrete anchors or screws.

FIG. 3 is a perspective view of the complete target assembly 200. A sign, 203, is used to hold an indicator light 204 and also to provide direction or instruction for the bumper boat attraction participants. For example, the sign may include the phrasing "Bump when lit". Vertical members or brackets 205 are fixed to the horizontal mounting bracket 202 to project upward therefrom at a distance spaced along the parallel lengths of angle iron from the target pad support plate 201 to allow for the connection of the sign 203 and light 204 to the main mounting bracket. With the sign and attached light carried on the vertical members 205 above the bracket 202 mounted poolside, participants riding in the boats as per the normal manner of conventional bumper boat attraction can watch for the light 204 to illuminate to indicate that the target is active. They now can now attempt to steer their boat over to the target, with intention of activating the water effect device by performing an input action on the target. The illustrated target assembly features a target pad 206 that is coupled to or forms part of a pressure switch and is mounted to the front face of the target support plate 201 through use of fasteners passed through corner holes 201*b* proximate the four corners of the plate 201. The target pad, when struck by the boat, when the light 204 is illuminated closes the pressure switch of the target assembly, which sends a signal to a control system or module. In response to this signal, the control will send an activation signal to the water effect device 300 to carry out a water effect such as a water cannon, water blast, spray, mist, air assisted mist, or water dump.

In the illustrated embodiment of FIG. 6B, the water effect 300 is directed toward the pool from the apron at a position spaced from the target assembly 200 at an angle directed further away therefrom so as to attempt to convey water upon a participant other than that who hit the target. In other embodiments, the water effect may be located at a other positions around or over the pool or directed to discharge water only partly over, or even away from, the pool so as to potentially direct water at future participants waiting in line for the attraction or spectators in the general area closely surrounding the attraction. In the embodiment of FIG. 6B, where the main target assembly is affixed to the pool apron 130 and the water effect device is placed within a relatively short distance from the target along the same side of the pool apron, the length of wiring interconnecting the target and the water effect device via the controller is kept relatively low and the angling of the water effect device's direction of water discharge away from the target avoids, or at least minimizes the chances of, exerting the water effect on the participant responsible for that particular occurrence of the water effect. The embodiment of FIG. 6A illustrates how a water effect 300' need not necessarily be angled away from the target assembly 200' to avoid spraying a participant proximate the target, and for example may even be angled toward the target assembly but sufficiently spaced therefrom to avoid the water effect from reaching the target area.

FIG. 4 depicts a mechanism 400 that may be used in the water effect device 300, 300' to create an explosion or blast of water. A smaller diameter tube 410 and a larger diameter tube 407 are coaxially connected end-to-end using a coupler fitting 408. The larger hollow tube is open at one end and constructed in such a manner to allow for the insertion of water into the tube while held at an oblique angle relative to horizontal to position the open end of the larger hollow tube above the opposite end. Electronically controlled valves 409, 411 are used to control flow from both an air source and a water source. A compressed air source is communicated with a reservoir tank 412 coupled to the end of the smaller tube 410 opposite the larger tube 407 through air control valve 411 at an end of the reservoir tank 412 opposite the air control valve. A pressurized water source is communicated with the smaller tube 410 at a position between its ends through an orifice constructed in the tube wall and communicating with water control valve 409. The reservoir tank 412 is used in the illustrated embodiment to provide storage for compressed air from the air source, although the water effect unit may be used without the tank 412 and instead couple the air source directly to the smaller tube through the air control valve 411.

When the electronic controller activates the light 204 of the target assembly 200 to indicate the activation of the target and a participant performs an input action at the target before the light goes out and the target is deactivated, the signal sent to the controller by the closing of the target's pressure switch causes the controller to send an activation signal to the water effect device, particularly to the water and air control valves 409, 411 when the water effect unit 400 of FIG. 4 is used. This signal opens the two valves sequentially, first causing a predetermined amount of pressurized water to be injected into the smaller tube 410 and then a predetermined amount of pressurized air to enter the smaller tube 410 and subsequently discharge from the unit 400 through the open end of the larger diameter tube 407. The release of the pressurized air from the normally closed end of the smaller tube behind the entry point of the previously injected water that pools toward this normally closed end during the delay between the sequential valve openings causes the water to spray outward from the open end of unit in a blast, as a more cohesive stream or charge of water. The purpose of said device is thus to produce an explosion of water through the primary addition of water to the hollow tube and a secondary actuation of compressed air into the bottom of the tube. This is only one example of a water effect unit, and it will be appreciated that others may be employed to convey a stream, charge, mist or other water effect in response to an activation signal from the controller.

In alternate embodiments, the water effect mechanism may have the water enter into the open tube end directly. Water may be pumped into the tube by submersion of an electrical pump into a water container or pool, as an alternative to the above described injection of water into the tube by the actuating of a valve hooked up to a pressurized water source. The closed end of the tube may have a fitting to allow for the direct attachment of an air valve controlling the pressurized air source as an alternative to the illustrated embodiment in which a smaller air pipe or tube is coupled to the larger tube from which the water is discharged in operation of the mechanism to produce a water effect.

The water effect mechanism may feature a nozzle constructed in such a way that a water source may be connected within the end or to the end of the nozzle. The water source may feature a hollow tube to act as a siphon from a water container or pool of water, or again may feature an electronic valve operable to actuate a pressurized source of water. The nozzle shall also allow for the attachment of a pressurized air source actuated electronically or mechanically. The purpose of such a nozzle-equipped device would be to produce an air-assisted water mist. In a further alternative, the water effect mechanism may feature a spray or misting tip arranged to employ electronic or mechanical actuating of a valve with a pressurized water source. The purpose of the device would be to produce, without the assistance of compressed air assistance, a water spray or mist, or in the case of an electronic actuating valve, a pulsed water spray or mist effected by repeated opening and closing of the valve at sufficiently frequent intervals.

FIG. 5 is a perspective view of one ornamental design for a housing of a water effect unit like that of FIG. 4 to give the resulting water effect device a unique, appealing appearance. The housing design of FIG. 5 simulates the appearance of a cannon, and the mechanism of FIG. 4 can be placed within the barrel 313 of the cannon to discharge water from the open end thereof when activated by the controller. FIG. 7 is a perspective view of another ornamental design for housing said water effects, this one having the overall outer shape of a Tiki. The mechanism in FIG. 4 may be placed within the mouth, 315, of the Tiki. These are of course only two examples of many possible housing designs that can be used. For example, in addition to the cannon shaped water effect device, a device with an outer appearance of an aged wooden crate may lend atmosphere to a pirate-themed water attraction.

FIG. 10 shows an electronic system layout for the electronic target described above. Under the input action of a participant, the target may complete or break a circuit between the target and the control module or instead generate a signal and send it to the control module, which is configured to recognize the result of either of these actions as a signal indicative that the target has been "hit". As an alternative to a press type switch to be opened or closed upon being hitting of the target by a boat or shot of water sprayed therefrom, the signal may be generated by triggering of a sensor arranged to detect the presence of a boat proximate the target or the presence of water in a water collection and retention area on the target that fills upon spraying of the target with water and drains after being retained in the area long enough for detection by the sensor. From these different possible ways to detect an intended triggering of the target by a participant, it will be appreciated that the electrical signal received and recognized or translated by the control module may be generated by the participant action directly or indirectly. The signal produced upon occurrence of an input action of a participant may be transferred to the control module through a wired or wireless communication link. Embodiments using a proximity sensor to detect the presence of a boat proximate the target may have the control module configured to effect a single water effect occurrence when the proximity sensor is first triggered, and allow another water effect occurrence to be actuated only after the target light has turned off and then later relit or only after the originally detected boat has left the sensor-monitored area of the pool.

As described above, the control module may periodically activate a light proximate the target to indicate to participants that the target is "active" and a corresponding trigger of that target will produce a water effect. While the light is lit, the control module will, upon detecting the occurrence of the triggering action by the participant, send an activation signal to one or more electronic valves to release a pressurized water source, a pressurized air source or both in order to propel a spray, shot, pulse or stream of water from the water effect device. The actuating of these valves may occur simultaneously or at some desired time interval provided by the control module. For example, to produce an air-assisted mist, both the water and air valves are actuated simultaneously, but to instead produce a water cannon shot or blast, the water is first injected and then the air is subsequently fired to produce the effect. Alternatively, the water effect device may be a water dumping arrangement, with the activation signal activating an actuator to tip over a container of water or open a discharge opening therein to pour or drain water therefrom over the pool to potentially wet the participants of the attraction or over an area nearby the pool to potentially wet spectators or future participants waiting in line for the attraction. It will be appreciated that although the target assembly of the illustrated embodiment is affixed directly to the side, apron, or immediate area surrounding the bumper boat pool or pond, it may be supported in other manners and positions, for example suspended over the pool or pond.

Multiple targets and effects can be used around the area to further enhance the experience.

FIG. 11 shows how an array of control modules may be connected to a main processor or controller in order to provide a bumper boat attraction with multiple pairings of a target and a water effective device. The main controller is preferably provided with an on or start button which activates a timer that has been programmed according to a desired ride time for the attraction. Accordingly, once all participants have boarded their bumper boats and are free to begin traveling around the pool, an operator of the attraction can press the start button or otherwise close an "on" switch so that the timer begins to count down from an amount of time equal to the desired ride period. An expiry signal or indicator is activated at the expiry of the timer to indicate the end of the ride to the operator and/or to the participants. The expiry signal may be a visual indicator or an audible signal or alarm, for example an audible announcement broadcast over the attraction area using an amplifier system powering one or more speakers.

The multiple control module system will allow for the control modules to receive commands from the main processor and also allow the main processor to continually check the status of the modules. With all modules continuously powered, they may be sequenced for individual intermittent operation of their targets by the main controller. The indicator light and the target are controlled by the individual modules along with the ability to actuate the electronic solenoid valves. So in the event a main controller/processor is used there are a number of possibilities. The processor may tell a target to come active by signaling the respective control module, and thus light the corresponding indicator light. The processor will be checking to see when/if the target has been hit, and then either send a command to the control module of that target to fire the water effect which that module controls, or send a command to a different control module to fire a different water effect, or in the event the target has not been hit, activate a new module/target. The processor adds to the basic functionality of the control modules and also provides a venue for sound, ride timers, and the sequencing of multiple effects for an attract sequence.

Each independent module in this system may be configured to operate in the stand alone manner of FIG. 10 when no main controller is coupled to it, so as to self trigger intermittent activation of its target, and operate in the multiple target mode of operation of FIG. 11 when coupled to a main controller, so as to only activate its target when instructed to do so by a signal from the main controller. Accordingly, a system can operate in the absence of a "main controller/processor", and in this instance, the target could remain powered continuously and have the ability to activate the indicator light at predetermined time intervals and optionally also trigger the water effect in the absence of a participant signal for a predetermined amount of time. Accordingly, the single-module system in FIG. 10 can stand-alone, yet used as part of an attraction have multiple stand-alone target and water effect combinations around a pool.

In embodiments where different control modules each individually send an activation signal to the main controller when the target controlled by that module is triggered, the main controller may be configured so that the water effect activated by that triggering is accompanied by a sound effect or audible signal broadcast over the sound system. In timer-equipped embodiments, a singular effect may be triggered multiple times at the end of the ride, or multiple effects may be triggered simultaneously or sequenced to produce a choreographed display to signify the end of ride.

Another embodiment having multiple pairings of targets and water effect devices may alternatively forgo multiple control modules, and instead be controlled solely through a central controller receiving signals from each target and outputting signals to the respective water effect devices accordingly. The system may be programmed to send a signal to any of the multiple effects when it receives a signal from any target. The controller may be programmed to send multiple signals to one or more effects making a sequenced display of any or all of the water effects with or in absence of the participant signal. Another embodiment of the system may have multiple targets coupled to a single water effect device and may use a single controller communicating with each target and with the sole water effect device. In such an embodiment, the controller may be configured or programmed to illuminate the "target activated" lights of the targets only one at a time and with a delay between them to prevent continuous running of all the targets. The order in which the targets are activated in such a sequence may be randomized to be unpredictable for participants, and may include the lighting of multiple targets at the same time.

Any of the electronic control systems described above may trigger water effect occurrences in the absence of input from a participant for the purpose of demonstrating the system to both bumper boat participants and spectators. For example, the system may periodically activate one or more water effect during times when the ride-time timer is not running and no participants are out on the pool in the boats. Setting off effects and sound at preset times whether or not there is participants present in the area acts to attract new participants to the attraction.

As mentioned above, the system may incorporate targets that are triggerable by driving a bumper boat against a contact area of a target or targets that are instead triggerable by spraying of the target with a shot or stream of water from a bumper boat equipped with a water shooting device. FIGS. 12 and 13 illustrate an example of a water-actuated triggered assembly 500.

With reference to FIG. 12, the water-actuated target assembly 500 features a plate-like sign 502 presenting flat front and rear faces and having a circular outer perimeter, although it will be appreciated that other shapes of signs may alternatively be used. As in the boat actuated target assembly of FIG. 3, a light 504 is mounted on the sign to face forwardly therefrom so as to be visible from a front side of the sign when illuminated. Again, the sign may incorporate written or illustrative instructions printed on, stamped in, adhered to or otherwise applied on the front face of the sign to direct participants of the bumper boat attraction on how to trigger the target. Accordingly, the front face of the target sign of FIG. 12 features the words "Spray target when lit" so that participants will attempt to spray the target with the water shooting devices on their boats. An electronics enclosure or housing 506 is mounted to the sign 502 so as to be supported in a position adjacent the rear face thereof, for example by way of aligned fastener holes 508, 510 in the enclosure walls and the sign. Referring to FIG. 13B, a electronic control module 512 of the target assembly is housed and protected within the enclosure 506. A piezoelectric disc 514 is mounted on the housing to present a face of the disc outside the enclosure 506 on a front side thereof. Referring back to FIG. 12A, a hole 516 in the sign 502 is axially aligned with the piezoelectric disc so that the disc 514 is positioned just behind the sign 502 and is visible and accessible through the hole 516 therein. Accordingly, a participant of the bumper boat attraction can spray the disc 514 through the hole 516 in the sign. The hole 516 in the sign is preferably centered thereon, as shown in the illustrated embodiment.

The piezo disc vibrates in response to contact from the water and produces an electrical current. This current is then interpreted by the control module within the enclosure which will determine if in fact the target is producing sufficient vibration to signify that the target has been "hit" with a water spray. As described for other embodiments, the control module may intermittently activate the target and signal this activation to the participants by keeping the light 504 on the sign 502 lit only during these periods in which the target is active. Accordingly, the control module 512 is wired to the light 502 through another hole or opening 518 in the sign plate 502 at a position behind the light 504. This wiring may be achieved using a short patch cable or pigtail connection 520 between the electronics enclosure 506 and a housing of the light 504 to facilitate easy wiring of each target. The complete assembly is free to be mounted to any suitable support structure using known mounting or fastening techniques at any desired location proximate the bumper boat pool so as to be sprayed at by the participants during operation of the attraction.

As an alternative to the electronically controlled systems described above, FIG. 8 schematically shows a mechanical system layout for a mechanical target that actuates a mechanical lever, system of levers or linkage to actuate a singular mechanical valve or multiple mechanical valves connected to a water source, resulting in a water effect being produced. FIG. 9 shows a mechanical system layout for a mechanical target actuating a mechanical lever or system of levers to actuate a singular or multiple mechanical valves connected to both air and water sources. This system may be used to produce a larger air-assisted water effect. A mechanical system would lack the "target active" light of the illustrated target assembly and instead be actuable at any time. Electronically controlled embodiments may similarly be used in the absence of an indicator light, In these instances, the target would remain "live" as long as power is supplied to the electronic system or water is supplied to the mechanical system.

Applying participant triggered water effects to a bumper boat attraction where participants are restricted to a confined area and given independent control of vehicles that can bump, spray or otherwise trigger targets provides a whole new level of interaction and excitement over prior art bumper boat attractions and water play areas. More ability to cause water to be splashed on other participants is provided over conventional bumper boat attractions, and skill and strategy in driving a boat toward a target provide an elevated level of unpredictability over water play areas where one only need to walk up to a trigger point to successfully activate a water effects. Further, the use of a light or other indicator near the target to signify when to bump said target adds further challenge and excitement. If struck when light is not lit, the target will not activate the water effect and may even activate a secondary water effect directed at the participant who bumped or sprayed the target. This adds a level of skill and timing, and participants may bump and jostle each other trying to hit the target or prevent the other participant from hitting the target.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A bumper boat amusement attraction comprising:

a body of water;

a plurality of bumper boats deployable out over the body of water to be driven along a surface thereof by respective participants;

a target disposed proximate the body of water and arranged to provide an output action in response to an input action taken upon the target by one of the participants; and a water effect device arranged to be activated by the output action of the target to produce a water effect;

wherein the target is wired to an indicator that is arranged to intermittently activate to signal the participants to attempt to take the input action on the target and the target is arranged to provide the output action in response to the input action only if the input action is taken upon the target while the indicator is activated.

2. The bumper boat amusement attraction of claim 1 wherein each bumper boat comprises a water shooting device operable by the respective participant to propel water through the air above the surface of the body of water and the target is arranged to provide the output action in response to being contacted by the propelled water.

3. The bumper boat amusement attraction of claim 1 wherein the indicator comprises a visual indicator providing a visual signal at a position viewable by the participants.

4. The bumper boat amusement attraction of claim 1 wherein the indicator comprises a light situated at a position viewable by the participants.

5. The bumper boat amusement attraction of claim 1 wherein the target comprises a sensor operable to detect presence of one of the bumper boats proximate the target and effect the output action in response thereto.

6. The bumper boat amusement attraction of claim 1 comprising a sound device arranged to convey audible signal in response to the input action taken on the target.

7. The bumper boat amusement attraction of claim 1 comprising an electronic control system arranged to activate the water effect device in response to the input action at the target and also activate the water effect device absent the input action.

8. The bumper boat amusement attraction of claim 7 wherein the control system comprises a main controller with a timer arranged to time a ride length of the attraction, is arranged to start the timer in response to an operator input and produce a ride expiry signal at the expiry of the timer, and is arranged to activate the water effect device absent the input action when the timer is not running.

9. The bumper boat amusement attraction of claim 1 comprising multiple ones of the target.

10. The bumper boat amusement attraction of claim 9 comprising multiple ones of the water effect device, wherein each water effect device is arranged to be activated by the output action of a respective one of the targets.

11. The bumper boat amusement attraction of claim 1 wherein the water effect device comprises a hollow tubular passage communicable with a water source to receive a predetermined amount of water in the tubular passage under each communication thereof with the water source and a normally closed gas valve openable to communicate a pressurized gas source with the tubular passage from an end thereof opposite an open end of the tubular passage, the normally closed gas valve being arranged to open under the output action of the target to expose the water in tubular passage to the pressurized gas source after full receipt of the predetermined amount of water in the tubular passage to drive the predetermined amount of water out of the tubular passage through the open end thereof.

12. The bumper boat amusement attraction of claim 11 wherein the water effect device comprises a normally closed water valve openable to communicate the water source with the tubular passage to deliver the predetermined amount of water thereto and the bumper boat amusement attraction further comprises an electronic control system arranged to open the normally closed water valve in response to the input action at the target and then, after a delay sufficient to allow full receipt and pooling of the predetermined amount of water in the tubular passage, open the normally closed gas valve to drive the predetermined amount of water out of the tubular passage through the open end thereof.

13. The bumper boat amusement attraction of claim 1 wherein the target comprises a switch actuable to effect the output action by driving of one of the bumper boats into contact with the target.

14. A bumper boat amusement attraction comprising:

a body of water;

a plurality of bumper boats deployable out over the body of water to be driven along a surface thereof by respective participants;

a target disposed proximate the body of water and arranged to provide an output action in response to an input action taken upon the target by one of the participants; and a water effect device arranged to be activated by the output action of the target to produce a water effect;

wherein the target comprises a switch actuable to effect the output action by driving of one of the bumper boats into contact with the target.

15. The bumper boat amusement attraction of claim 14 wherein the target is disposed adjacent a boundary edge of the body of water.

16. The bumper boat amusement attraction of claim 14 comprising a pool containing the body of water and wherein the target is mounted at a side of the pool above the surface of the body of water and depends downward from the side of the pool toward the surface of the body of water.

17. A bumper boat amusement attraction comprising:

a body of water;

a plurality of bumper boats deployable out over the body of water to be driven along a surface thereof by respective participants;

a target disposed proximate the body of water and arranged to provide an output action in response to an input action taken upon the target by one of the participants; and a water effect device arranged to be activated by the output action of the target to produce a water effect; and an electronic control system arranged to activate the water control device in response to the input action at the target, the control system comprising a timer arranged to time a ride length of the attraction and being arranged to start the timer in response to an operator input and produce a ride expiry signal at the expiry of the timer.

18. The bumper boat amusement attraction of claim 17 wherein the control system is arranged to convey an audible announcement at the expiry of the timer.

19. The bumper boat amusement attraction of claim 17 wherein the target comprises a switch actuable to effect the output action by driving of one of the bumper boats into contact with the target.

* * * * *